United States Patent [19]

Thuse

[11] 4,019,579

[45] Apr. 26, 1977

[54] APPARATUS FOR RUNNING, SETTING AND TESTING A COMPRESSION-TYPE WELL PACKOFF

[75] Inventor: Erik Thuse, Santa Clara, Calif.

[73] Assignee: FMC Corporation, San Jose, Calif.

[22] Filed: Mar. 3, 1976

[21] Appl. No.: 663,382

Related U.S. Application Data

[63] Continuation of Ser. No. 574,177, May 2, 1975, abandoned.

[52] U.S. Cl. ..... 166/123; 166/182; 166/208; 285/18

[51] Int. Cl.[2] ..... E21B 23/00; E21B 43/10

[58] Field of Search ..... 166/85.6, 120, 123–125, 166/181, 182, 208, 250, 315; 74/25; 285/18

[56] References Cited

UNITED STATES PATENTS

| | | | |
|---|---|---|---|
| 3,357,486 | 12/1967 | Brown | 166/.6 |
| 3,693,714 | 9/1972 | Baugh | 166/85 |
| 3,807,497 | 4/1974 | Baugh | 166/85 |
| 3,897,823 | 8/1975 | Ahlstone | 166/182 |
| 3,903,965 | 9/1975 | Ahlstone | 166/182 |

*Primary Examiner*—James A. Leppink

*Attorney, Agent, or Firm*—W. W. Ritt, Jr.; C. E. Tripp

[57] ABSTRACT

An apparatus and method for running a compression-type annulus packoff on a drill or other pipe string into an oil or gas well, setting the packoff without rotating the drill string, and then shifting the axial load of the drill string from the packoff to a casing hanger or other suitable well element so that the packoff can be pressure tested under conditions closely simulating normal service conditions. The apparatus comprises an hydraulically actuated well tool that functions both as a means for connecting the packoff to the drill string on which the tool and packoff are run as an assembly into the well, and also as a means for converting hydraulic pressure in the drill string into torque and then transmitting this torque to the packoff for rotating its seal-compressing element, thereby compressing its seal into fluid-tight engagement with the adjacent well elements. The tool can be employed for running and setting a plurality of packoffs at different levels in a wellhead or other outer well element, and can be retrieved from the well after completion of the setting procedure simply by lifting the drill string.

11 Claims, 26 Drawing Figures

FIG_2
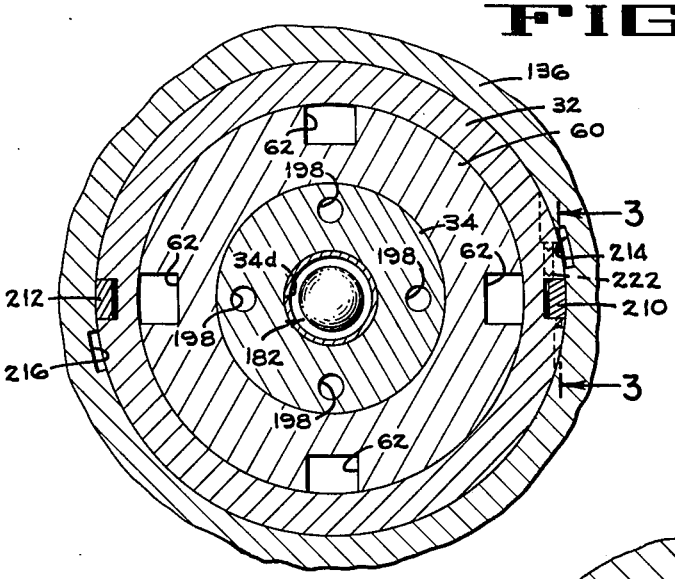
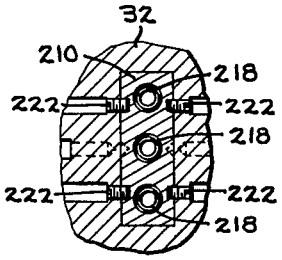
FIG_3
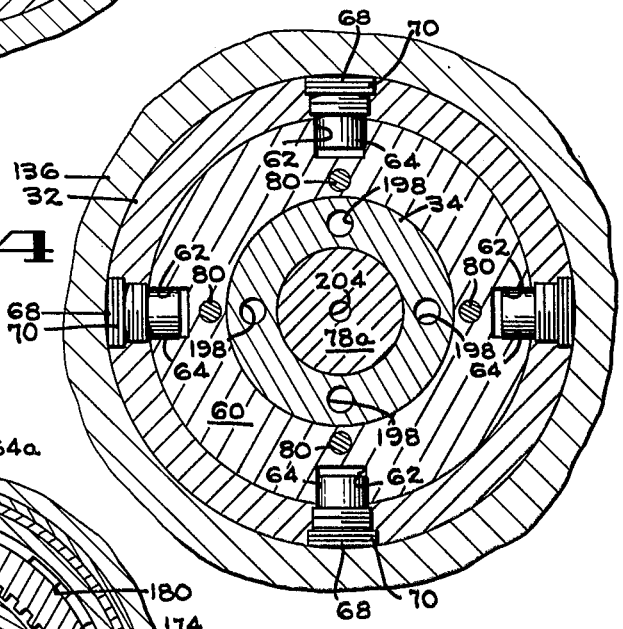
FIG_4
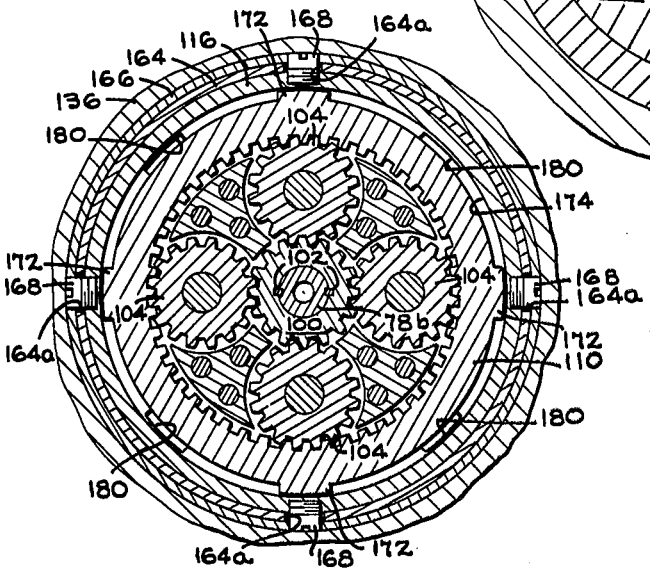
FIG_5
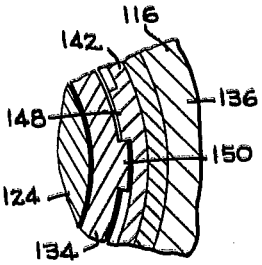
FIG_6

APPARATUS FOR RUNNING, SETTING AND TESTING A COMPRESSION-TYPE WELL PACKOFF

This is a continuation of application Ser. No. 574,177 filed May 2, 1975 now abandoned.

CROSS REFERENCE TO RELATED APPLICATIONS

The aforesaid Garrett application is a continuation of Garrett application Ser No. 574,145, filed on even date with the aforesaid. Thus, application Ser. No. 574,177.

The field of art to which this invention relates includes well tools, and more particularly tools for use in running, setting and testing packoff assemblies in oil or gas wells. United States patents on this type of apparatus can be found in class 166 of the United States Patent Classification System.

Prior to the present invention, various types of devices called packoffs have been used for sealing the annulus between two concentric well elements, such as a wellhead and an inner casing hanger. One well-known type of packoff has an annular resilient seal assembly with a smaller inner diameter and a larger outer diameter than that of the annulus in which it is designed to function, so that when this packoff is set in the annulus an interference seal sufficienT to hold the anticipated well pressure is established with the adjacent well elements. Although it has some desirable features, this type of packoff has a serious drawback in that its seal is easily damaged, especially while lowering the packoff through a close-fitting blowout preventer. When such damage occurs the seal must be replaced, since there is no provision for energizing the seal or otherwise overcoming the damage.

Another common type ofpackoff is set by utilizing the weight of its running string to axially compress the seal element and force if it expand radially into tight contact with the adjacent well elements, and then locking the packoff in this condition with hold-down devices called slips. One of the problems with this "weight-set" packoff is that the slips are different difficult release when it is desired to retrieve the packoff from the well. Another problem is that the tapered surfaces of the slips, which establish a friction lock between the packoff and the adjacent well elements, significantly limit the number of locations at which this type of packoff can be set.

A variation of the aforementioned "weight-set" packoff involves the use of hydraulic pressure to produce the downward force needed to compress the seal element sufficiently to establish an adequate pressure barrier. Since this "hydraulic-set" packoff also is locked in place by slips, it is plagued by the same disadvantages of the "weight-set" device.

The most commonly used type of packoff is run into the well on a drill string, and then set by rotating the string to exert torque on the packoff's seal-compressing ring, thereby forcing the seal radially into pressure-tight contact with the adjacent well elements. One of the most desirable advantages of this "torque-set" packoff is that after it has been set in the well the pressure-holding capability of its seal element can be increased by torquing it further, i.e., by further rotation of the drill string. However, when torque-set packoffs are employed at offshore locations where the wellhead is a significant distance below the drilling platform, such as on the ocean floor in deep water, a considerable amount of friction drag exists between the drill string and the walls of the riser, thus requiring the application of excessive torque on the string to fully set the packoff, and incurring the likelihood of serious damage to the string. Furthermore, the vertical movement of the drilling rig on an offshore floating platform makes it very difficult to maintain adequate control of the drill string while setting the packoff, especially during rough weather and heavy seas as, for example, are frequently experienced in the North Sea.

The invention described and claimed in the aforementioned copending Garrett application Ser. No. 650,101 overcomes the foregoing problems and achieves the aforementioned advantages by providing a new apparatus and method for running a torque-set packoff into a well on a drill or other pipe string, and then setting the packoff by torquing it to the desired pressure-holding condition without rotation of the drill string. The apparatus comprises a new type of running and setting tool that interconnects the drill string and the packoff, and that facilitates running, setting, and then pressure-testing the packoff in the absence of any axial load imposed on it by the drill sting and/or the tool. The packoff and this running and setting tool are connected in a releasable manner so that the tool can be easily disconnected from the packoff and retrieved from the well for further use.

The Garrett running and setting tool includes a piston that is operated by hydraulic pressure exerted through the drill string, a nut and screw assembly that converts the piston's linear force into torque, and a gear, spline, or other suitable system for transmitting this torque to the packoff. The tool is structured to impose its weight and that of the drill string on the packoff until the packoff is set, and then to transfer this weight to an inner casing hanger or other suitable well element before the packoff is pressure tested, thereby facilitating improved accuracy in measurement of the packoff seal's pressure-holding capability. Should the seal fail to hold the test pressure, the hydraulic pressure in the drill string is increased, thereby causing additional rotation of the packoff's seal-compressing element and further compression of the seal. The Garrett invention also enables this new well tool to be used for running and setting a plurality of packoffs sequentially and at different levels in a wellhead or other suitable outer well element.

In one embodiment of the Garrett invention, the piston of the running and setting tool is attached to the nut of a ball screw assembly, and the lower end of the assembly screw is connected to a gear system that transmits the torque of the screw, which torque is produced by downward movement of the nut in response to hydraulic pressure exerted through the drill string on the piston, to the rotatable seal-compressing element of the padoff. The greater the hydraulic pressure exerted on the piston of the tool, the greater is the amount of rotation of the tool's ball screw, the gear system, and the packoff's seal-compressing element, and thus the greater is the compressive force exerted on the packoff's seal. Accordingly, by means of the Garrett invention the packoff can be set to whatever pressure holding capability is required regardless of the distance thereof from the drilling platform or other location from which the drill string extends, and regardless of the operating conditions present at the surface.

SUMMARY OF THE INVENTION

The present invention involves improvements in the apparatus described and claimed in the above Garrett application Ser. No. 650,101, including (1) a modification of the ball screw assembly wherein the piston is connected to the helical screw instead of to the nut, (2) a helical spline system to convert the hydraulic pressure into torque, and (3) a simplified drive system in lieu of the gear assembly for directly connecting the ball screw, the nut, and/or the spline system to the rotatable seal-compressing element of the packoff.

The present invention also includes a novel resetting tool for returning the hydraulic piston in the running and setting tool to its original position after it has been forced downwardly in the tool by the hydraulic pressure in the drill string while setting the packoff. This novel resetting tool is run down the drill string into the interior of the padoff running and setting tool wherein it functions to reverse the direction of hydraulic pressure exerted on the running and setting tool, and thus causing the hydraulic piston to return to its original position.

When employing the apparatus of the present invention for installing a compression-set packoff, the packoff and its running and setting tool are run into the well as an assembly on a drill string or other pipe string, and the packoff landed on a previously installed casing hanger or other suitable element. Hydraulic pressure is then applied through the drill string to set the packoff, this pressure causing downward movement of the piston in the running and setting tool body and corresponding rotation of the screw assembly, the gear assembly or other system used for transmission of the torque from the screw assembly to the packoff, and the padoff's rotatable seal-compressing element. As the seal-compressing element rotates, it compresses the packoff's seal axially and forces it to expand radially into tight contact with the adjacent surface of the well elements between which the packoff is located, thereby sealing off the annulus between these elements.

When the packoff has been set, the blowout preventers are closed around the drill string and pressure is applied to the well bore between the preventers and the packoff such as through a choke and/or kill line. This pressure increases the axial load on the upper end of the running and setting tool, causing a position shift of some tool elements and resulting in transfer of the weight of the tool and the drill string from the packoff to the casing hanger or other suitable well element. In this condition, which is much more representative of that to be encountered in actual service, the packoff then is pressure tested. If the seal does not hold, the hydraulic pressure in the drill string is increased, thereby causing additional downward movement of the piston in the running and setting tool and ultimately further rotation of the packoff's rotatable seal-compressing element. Once the seal has been compressed sufficiently to hold the required pressure, a ball check valve is removed from the running and setting tool by means of a wire line through the drill string, and the drill string then picked straight up to remove the tool from the well and leave the packoff set in functional position.

Accordingly, one object of the present invention is to provide a new and improved tool for running, torque-setting, and pressure testing a compression-type packoff in an oil or gas well without rotation of the running string.

Another object of the present invention is to provide a new and improved means for exerting torque on a compression-type well packoff by hydraulic pressure conducted from a remote location through a drill or other pipe string to which the packoff is connected.

A further object of the present invention is to provide a new and improved packoff running and setting tool that facilitates pressure testing the packoff under conditions closely similar to normal service conditions.

Still another object of the present invention is to provide a new and improved means for increasing the pressure-holding capability of a compression-type well packoff after the packoff has been set in a well.

Another object of the present invention is to provide a new and improved means for converting hydraulic pressure in a pipe string into torque, and then applying that torque to a well tool for rotating a functional element of the tool.

Yet another object of the present invention is to provide a means new and improved for controlling and reversing the direction of fluid flow through a hydraulic fluid operated downhole well tool.

Further objects and advantages of the present invention will become apparent from the following detailed description thereof, including the accompanying drawings.

BRIEF DESCRIPTION OF THE DRAWINGS

FIG. 2 is a transverse section on a reduced scale, taken along the line 2—2 of FIG. 1A.

FIG. 3 is a fragmentary section on an enlarged scale, taken along line 3—3 of FIG. 2.

FIG. 4 is a transverse section on a reduced scale, taken along the line 4—4 of FIG. 1A.

FIG. 5 is a transverse section on a reduced scale, taken along the line 5—5 of FIG. 1B.

FIG. 6 is a fragmentary section taken along the line 6—6 of FIG. 1B.

DESCRIPTION OF THE GARRETT INVENTION

Figure 1A:
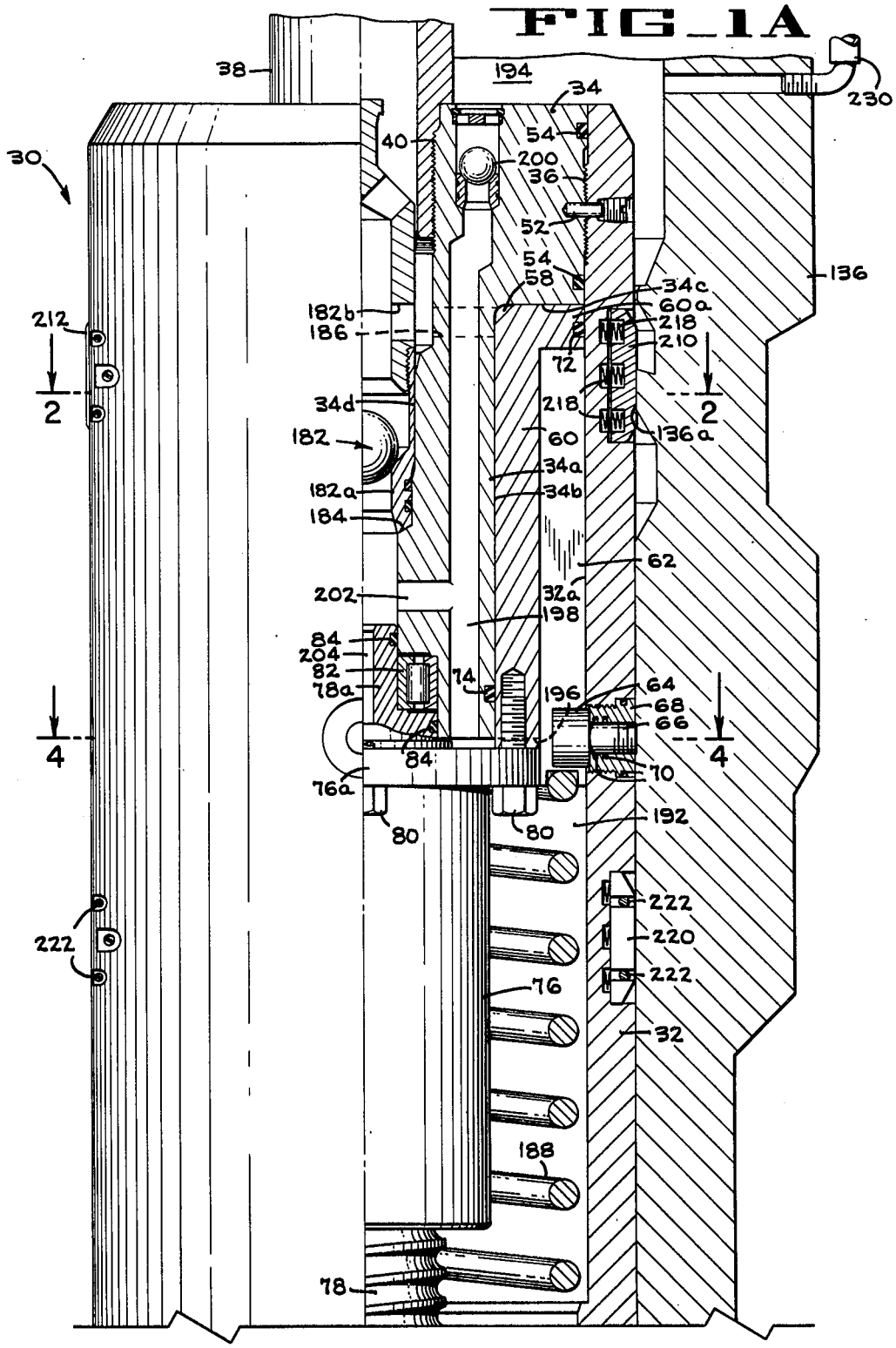
FIGS. 1A and 1B together comprise an elevation, partially in section, of one embodiment of padoff running and setting tool according to the aforementioned Garrett invention, illustrating the tool interconnecting a drill string and a packoff assembly which has been landed on a casing hanger in a wellhead, and showing the positional relationship of the elements prior to commencement of the packoff setting procedure.

The immediately following description of the Garrett invention, shown in FIGS. 1–10, is provided to enable the reader to more readily understand the several embodiments of the present invention as later described.

As illustrated in FIGS. 1–10, a packoff running and setting tool 30 according to the Garrett invention comprises a hollow elongate cylindrical body 32 that functions as a housing for the other tool elements, an annular upper end element 34 that is threaded at 36 to the interior of the upper end of the body 32 and that provides a means for connecting the tool 30 to a drill or other pipe string 38 as by threads 40, and an annular gear housing assembly comprising an upper gear housing 42 and a lower gear housing 44 releasably secured together as by a plurality of annularly spaced cap screws 46. The upper housing 42 is threaded into the lower end of the tool body 32 at 48, and unthreading of these two elements is prevented by an anti-rotation pin 50. In similar manner, an anti-rotation pin 52 prevents unthreading of the upper end element 34 from the tool body 32. Annular seals 54 establish a fluid barrier between the tool body 32 and the upper end element 34, and a fluid barrier is likewise established between the tool body and the upper gear housing 42 by annular seals 56.

The upper end element 34 of the tool 30 includes an elongated lower portion **34*a* having an outer annular surface 34*b* that is spaced inwardly from the inner annular surface 32*a* of the tool body 32, thereby defining an annular chamber 58 (seen best in FIGS. 7A,-8A,9A and 10A) in which is disposed an annular piston 60. The piston 60 is provided with one or more circumferentially spaced, external longitudinal grooves 62, and into each of these grooves extends a cam follower 64 for preventing relative rotation between the piston 60 and the tool body 32 while facilitating longitudinal movement of the piston within said body. Each of the cam followers 64 is rotatably mounted on a shaft 66 that is secured to the tool body by means of a threaded plug 68, and suitable seals 70** assure fluid-tight integrity between these elements.

The upper end **60*a* of the piston 60 is provided with an outer annular seal 72 that functions as dynamic barrier for hydraulic fluid between the piston and the tool body 32, and a similar seal 74 is provided at the lower end of the upper end elements' lower portion 34*a* for preventing escape of fluid between the piston and this element. Thus, when fluid pressure is admitted to the annular chamber 58 the piston 60 is forced downward, i.e., in an axial direction away from the downwardly-facing radial surface 34*c* of the end element 34, as shown in a sequential manner in FIGS. 1A, 7A, 8A, 9A and 10A.**

Positioned coaxially in the tool body 32 is a ball screw assembly (FIGS. 1A and 1B) comprising a nut 76 and a helically grooved screw 78. As is well-known, ball screw assemblies contain a plurality of spherical balls (not shown) that interconnect the nut and screw, and that move through a closed path that includes a channel or channels in the nut and the adjacent grooves of the screw as the nut moves axially on the screw. Such an assembly is commercially available from Beaver Position Products, Inc., a subsidiary of Warner Electric Brake and Clutch Co., Troy, Michigan, United States of America. The ball nut 76 has an annular flange **76*a* at its upper end, and the nut is secured to the lower end of the annular piston 60 by a plurality of cap screws 80 that extend through the flange 76*a* into the piston 60. Thus, the ball nut 76, along with the piston 60, is prevented from rotation with respect to the tool body 32 by the cam followers 64 and the piston grooves 62.**

The upper end **78*a* (FIG. 1A) of the ball screw 78 is supported in the lower end of the upper end element 34 by a radial bearing assembly 82, and annular seals 84 establish a dynamic fluid barrier between the screw 78 and the element 34. Surrounding and splined to the ball screw just below its helically grooved portion is an annular thrust plate 86 that supports the screw on the upper gear housing 42 through a thrust bearing assembly 88, and an O-ring 90 provides a static seal between the screw and the thrust plate, while a dynamic seal between the thrust plate and the upper gear housing is provided by an annular seal element 92.**

The ball screw 78 has a lower sleeve portion **78*b* (FIG. 1B) that extends downwardly from the helically grooved portion to terminate inside the lower gear housing 44, and annular seals 94 establish a dynamic fluid barrier between this sleeve portion and the lower gear housing. A pair of bearing assemblies 96 function to provide radial support between the sleeve portion 78*b* and the upper gear housing 42, and another radial bearing assembly 98 supports the sleeve portion in the lower gear housing 44, these bearing assemblies cooperating with the thrust bearing assembly 88 to assure that the ball screw 78** is adequately supported both axially and radially at its lower region.

The ball screw's sleeve portion **78*b* extends through a sun gear 100 (FIGS. 1B and 5), and these two elements are non-rotatably secured together by means of a plurality of keys 102. Surrounding, and in mesh with, this sun gear 100 are four planetary gears 104, each planetary gear being journaled in an upper and a lower bearing assembly 106,108 respectively, which bearing assemblies are supported in the upper and lower gear housings 42,44, respectively. Surrounding the planetary gears 104, and in mesh therewith, is an annulus gear 110 that is journaled on an upper bearing assembly 112 on the upper gear housing 42, and on a lower bearing assembly 114 on the lower gear housing 44. Thus, as the ball screw 78 rotates, the sun gear 100 rotates with it, causing rotation in the opposite direction of the planetary gears 104 and the annulus gear 110. As will later be described in detail, the annulus gear 110 is connected to an annular rotatable element 116 of a packoff 118, so that the sun gear 100, planetary gears 104, and annulus gear 110 comprise a transmission assembly for transferring the torque of the ball screw 78 to the packoff 18**.

A tubular element 120 (FIG. 1B) that functions as a means to attach drill pipe to the bottom of the running and setting tool 30 is threaded onto the lower end of the lower gear housing 44, and an anti-rotation pin 122 prevents accidental unthreading of these elements. Surrounding and threaded onto the tubular element 120 is an annular spacer element 124 with an anti-rotation pin 126, and this spacer element 124 has an outer annular groove 128 that serves as a chamber for an annular seal element 130, this seal element being retained in the groove 128 by a seal retainer ring 132. The seal element 130 establishes a fluid-tight barrier between the spacer element 124 and an adjacent outer well element, such as the casing hanger 134, when the running and setting tool 30 and the packoff assembly 118 are properly positioned in the well, as in a wellhead 136. Annular seals 138 establish a fluid barrier between the spacer 124 and the tubular element 120, and annular seals 140 function likewise between the tubular element and the lower gear housing 44. Accordingly, with the running and setting tool 30 in its illustrated position in the wellhead 136 no fluid can pass downwardly between the gear housing 44 and the casing hanger 134.

Figure 1B:
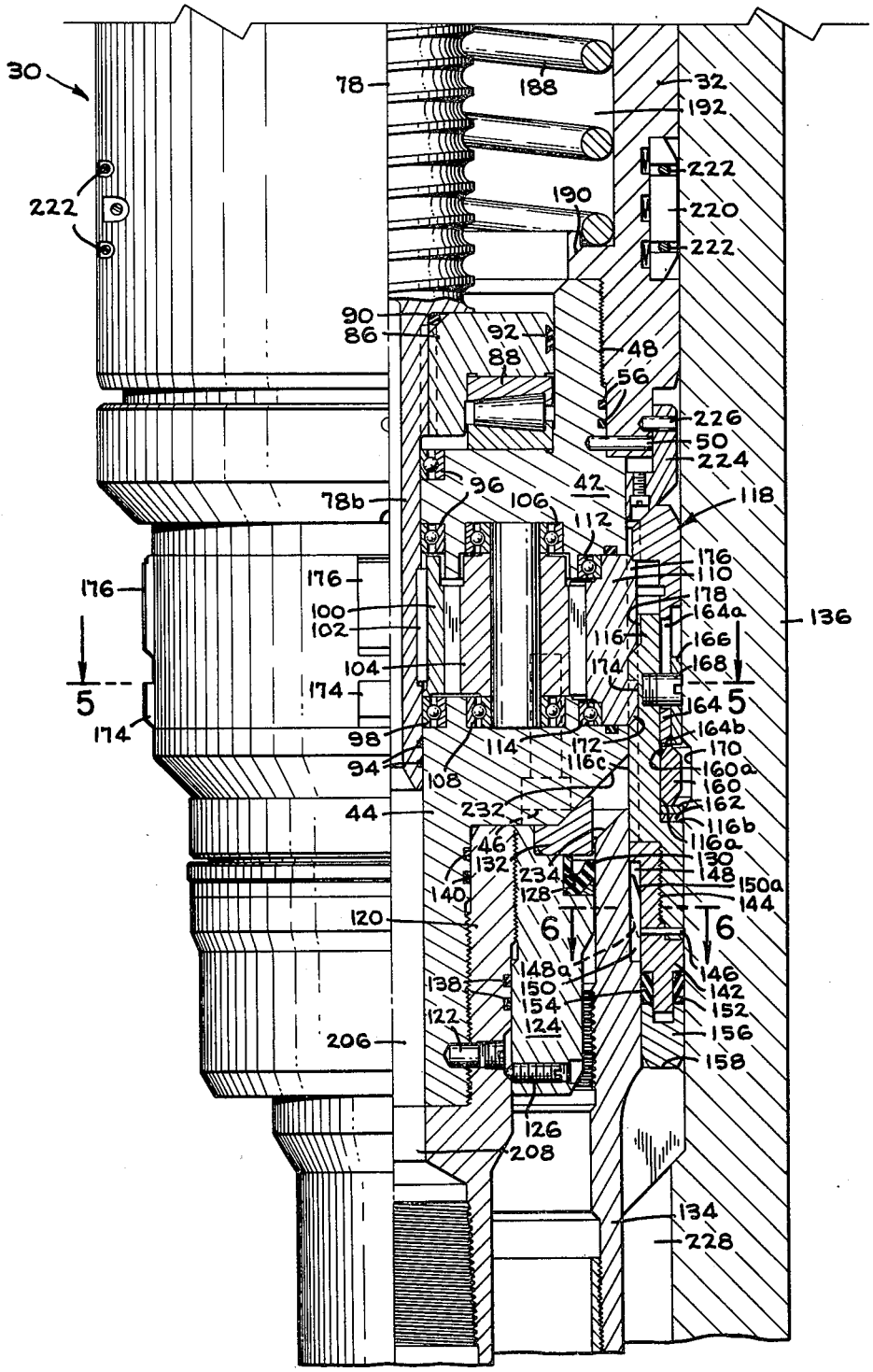

As seen in FIG. 1B, the packoff assembly 118 comprises the upper rotatable body element 116 threadedly connected to a lower body element 142 by left hand threads 144, and these two body elements are prevented from unintentional unthreading by a shear pin 146. The lower body element 142 (FIGS. 1B and 6) has a pair of diametrically opposed lugs 148 (only one shown) that cooperate with a corresponding pair of lugs 150 (only one shown) on the casing hanger 134 to prevent rotation of the body element 142 with respect to the hanger and wellhead 136. Adjacent the lower end of the body element 142 are a pair of resilient annular seal elements 152,154 that are compressed axially between the body element 142 and a support ring 156 at the bottom of the packoff. During the setting procedure, the support ring 156 rests on the shoulder 158 of the casing hanger 134 when the padoff is in its landed position in the wellhead 136 (FIG. 1B).

Surrounding the upper, reduced diameter outer surface **116*a* of the packoff's rotatable body element 116 is a contracted, expansible split setting ring 160 that is prevented from downward movement on the body element 116 by a pair of thrust rings 162 which rest on top of an annular upwardly facing shoulder 116*b* on the element 116. Disposed above the setting ring 160 is an annular setting mandrel 164 that is axially slidably retained on the packoff's rotatable body element 116 by a retainer sleeve 166 which is fixedly secured to the body element 116 by four circumferentially spaced retainer pins 168 (FIGS. 1B and 5), the pins 168 extending through axial slots 164*a* in the setting mandrel and into threaded engagement with the body element 116. The lower end of the setting mandrel 164 has an outer beveled surface 164*b* that cooperates with an inner beveled surface 160*a* at the top of the setting ring 160 to cam the ring outwardly into the opposed groove 170 in the wellhead 136 when the mandrel is forced downward between the ring and the packoff's rotatable body element 116** during the setting procedure, as will later be explained more fully.

Extending radially outwardly from the outer surface of the running and setting tool's annulus gear 110 are four circumferentially spaced lower lugs 172 (FIGS. 1B and 5) that reside in an inner annular groove 174 in the inner surface **116*c* of the packoff body element 116 when the packoff and the tool are connected together as an assembly for running into the well. Above the lugs 172, and in axial alignment therewith, are four upper lugs 176 on the annulus gear (FIG. 1B), these upper lugs residing in a counterbore 178 in the upper end of the body element 116 when the packoff and the running and setting tool are assembled together for running. The inner surface 116*c* of the packoff body element 116 also has four axial slots 180 spaced to coincide with the lugs 172,176. Thus in connecting the packoff assembly 118 and the running and setting tool 30, the lugs 172,176 are aligned with the slots 180, the packoff is then moved axially onto the tool until the lower lugs 172 are in registration with the groove 174, and the packoff is then rotated to move the lugs 172,176 out of alignment with the slots 180. This procedure "jays" the packoff onto the running and setting tool, and it is in this jayed condition that the packoff and tool are run as an assembly into the well on the drill string 38**.

OPERATION

The procedure for running, setting and pressure testing in packoff 118 with the running and setting tool 30 of the present invention is as follows.

The packoff is installed on the tool as explained above, and then these two devices are run into the well on a drill or other suitable pipe string 38 until the packoff lands on the shoulder 158 of the casing hanger 134. Should by chance the lugs 148 of the packoff be aligned with the lugs 150 of the casing hanger as the packoff approaches the hanger shoulder 158, when the knife-like sloping lower surfaces **148*a* of the lugs 148 and the similarly shaped upper surfaces 150*a* of the lugs 150 come into contact they will cause the packoff to rotate slightly so that it can continue downwardly and come to rest on the casing hanger shoulder 158, the condition in which it is shown in FIGS. 1A and 1B**.

When the packoff has been landed, hydraulic pressure is admitted to the interior of the drill string 38 from a suitable location at the surface, as at the drilling platform. A wireline retrievable ball check valve 182, with a valve body **182*a* seated on a shoulder 184 in the bore 34*d* of the tool's upper end element 34, prevents hydraulic fluid from flowing further downward through the element 34, while a lateral flow to the annular piston chamber 58 is facilitated by a port 182*b* in the check valve body and a radially oriented passage 186 in the tool's upper end element 34. Hydraulic pressure in the chamber 58 causes the piston 60 to move downward against the force exerted on it by a coil spring 188 that surrounds the ball screw assembly and extends from an annular flange-like support 190 on the inside of the tool body 32 to the bottom of the piston, the spring thereby constantly biasing the piston towards its uppermost position (FIG. 1A). As the piston 60 moves downward, well fluid or any other fluid present in the annulus 192 below the piston and between the tool body 32 and the ball screw assembly exits to the well bore 194 above the tool through radial passage 196 (best seen in FIGS. 7A, 8A, 9A and 10A) in the bottom of the piston, and thence upwardly through four axial passages 198 (FIGS. 1B and 2) and four check valves 200 (only one shown) in the tool's upper end element 34.**

Figure 7A:
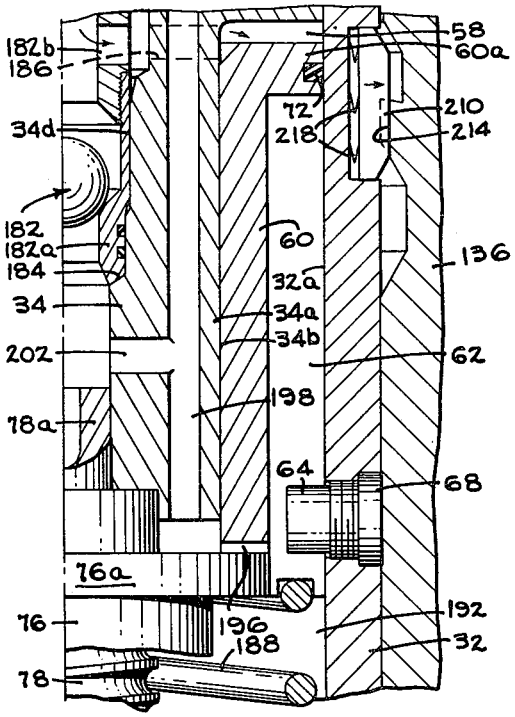
FIGS. 7A and 7B are fragmentary elevations in section of the upper and lower portions, respectively, of the running and setting tool, the packoff assembly, the casing hanger, and the wellhead of FIGS. 1A and 1B, illustrating the relative positioning of these devices immediately after the running and setting tool body has been secured to the wellhead against rotation.
Figure 8A:
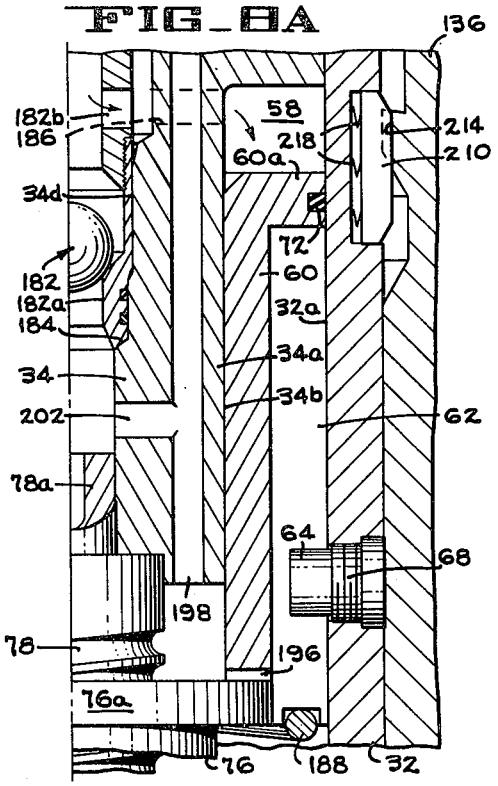
FIGS. 8A and 8B illustrate the relative positions of the elements shown in FIGS. 7A and 7B after the packoff assembly has been locked to the wellhead.
Figure 7B:
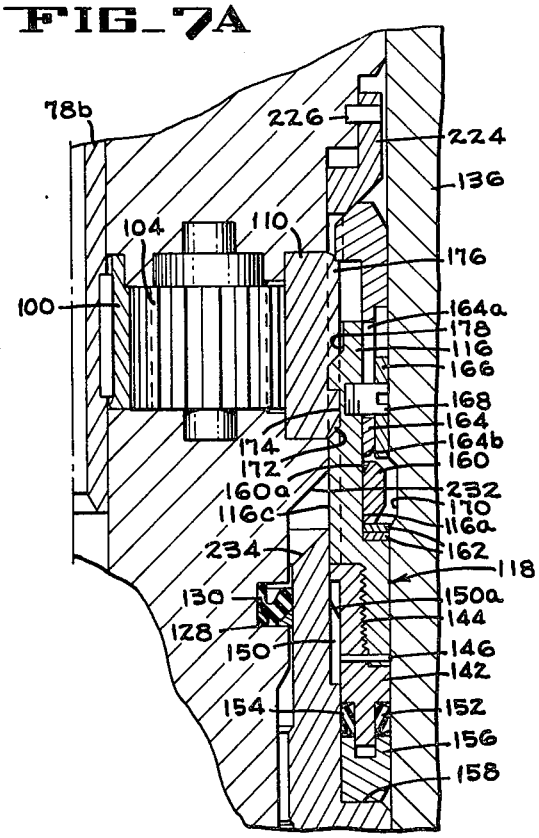
Figure 8B:
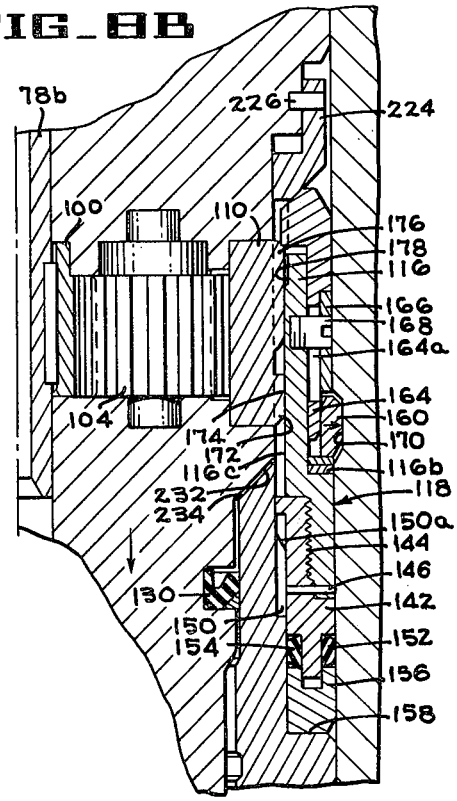

Initial downward movement of the piston 60 causes the entire tool 30 to rotate until a pair of diametrically opposed reaction dogs 210,212 (FIGS. 1A and 2) in the outer surface of the tool body 32 comes into alignment with a corresponding pair of axial slots 214,216 in the inner annular surface 136*a* of the wellhead 136, at which time these dogs 210,212 are forced outwardly into these slots by springs 218, all as is diagrammatically illustrated in FIG. 7A. This precludes further rotation of the tool body 32, and of course also the piston 60 and the ball nut 76. Additional appropriately spaced reaction dogs 220 (FIGS. 1A and 1B) are provided on the tool body 32 so that the tool 30 can be employed to run and set a plurality of packoffs sequentially at successively higher elevations, but while the packoff 118 is being run and set in the wellhead 136 these dogs 220 are releasably retained in contracted position by screws 222 (FIGS. 1A, 1B and 3).

Additional downward movement of the piston 60 causes rotation of the ball screw 78, the sun gear 100, the planetary gears 104, and the annulus gear 110. When the lugs 172 and 176 on the annulus gear 110 come into alignment with the axial slots 180 (FIG. 5) in the packoff's rotatable element 116 the running and setting tool drops so that the lugs move downward into the slots, thereby preventing further relative rotation between the annulus gear 110 and the packoff's rotatable element 116, as diagrammatically illustrated in FIGS. 8A and 8B. As this drop is occurring, a slip ring 224, which surrounds the lower end portion of the tool body 32 and is secured thereto by a plurality of shear pins 226, forces the setting mandrel 164 downward behind the setting ring 160, thereby forcing the setting ring to expand into the opposing groove 170 of the wellhead 136 and locking the packoff in the wellhead.

Figure 9A:
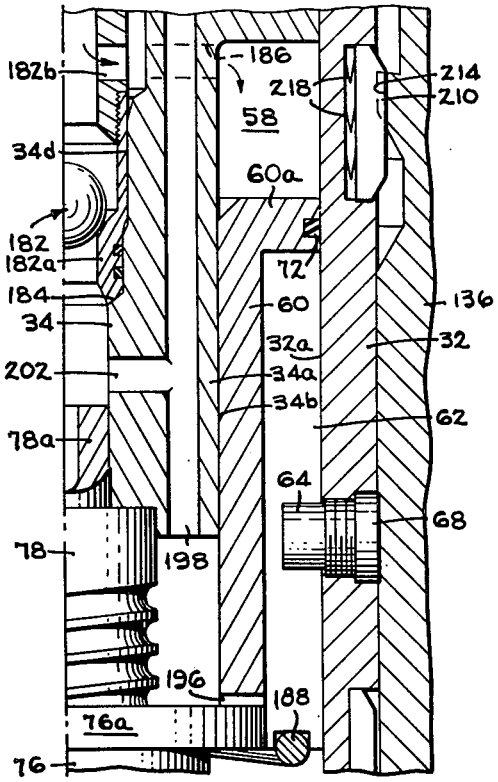
FIGS. 9A and 9B illustrate the relative positions of the elements shown in FIGS. 7A and 7B after the packoff assembly has been set between the casing hanger and the wellhead.
Figure 10A:
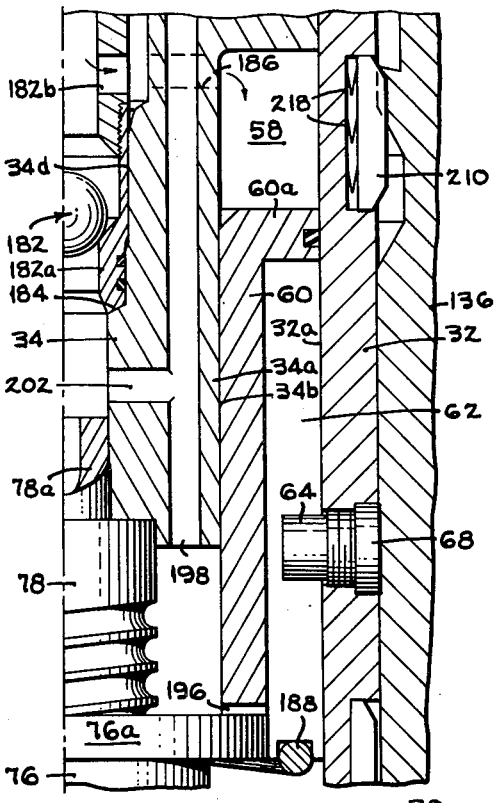
FIGS. 10A and 10B illustrate the relative positions of the elements shown in FIGS. 7A and 7B after the axial load of the running string and the running and setting tool have been transferred from the packoff to the casing hanger to prepare the packoff for pressure testing.
Figure 9B:
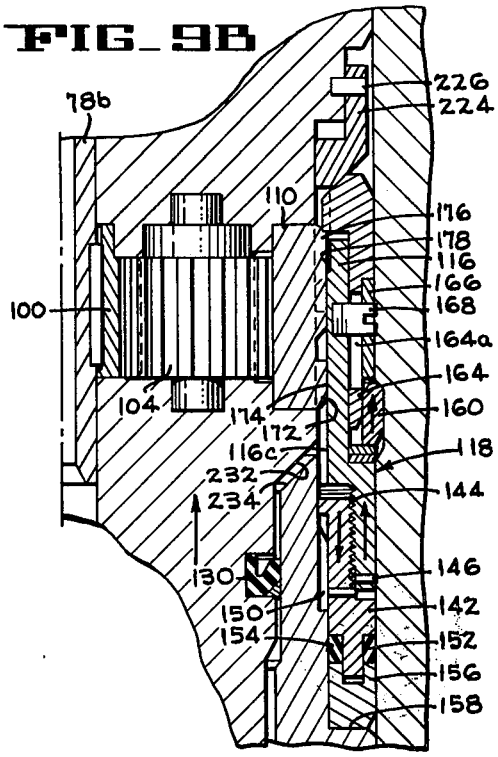

As illustrated in FIGS. 9A and 9B, further rotation of the annulus gear 110 to the right breaks the shear pin 146 and causes the packoff's rotatable element 116 to rotate with the annulus gear. Since the packoff's lower body element 142 is prevented from rotation by the cooperative action of the lugs 148,150, as the packoff's upper body element 116 rotates it also moves upward through the left hand threads 144 until the setting ring 160 comes to rest against the top of its groove 170. This rotation also causes whatever downward movement of the packoff's lower body element 142 is required to axially compress the seal elements 152,154 and force them radially into pressure-tight contact with the inner surface of the wellhead 136 and the outer surface of the casing hanger, respectively, thus sealing off the annulus 228 between these elements from the well bore 194. As will be understood, the amount of torque applied to the packoff, and thus the pressure-holding capability thereof, can be increased simply by increasing the hydraulic pressure in the drill string 38, thereby forcing the piston 60 further downward and of course further rotating the packoff's upper body element 116.

With the packoff set, the blowout preventers (not shown) are closed around the drill string 38, and pressure is applied to the well bore 194 through the choke and/or kill line 230 (FIG. 1A). This pressure is contained by the blowout preventers, the check valves 200, the seals 54, 56, 70, 90, 92, 94, 130, 138 and 140, and the packoff's seal elements 152,154. If the difference between the outside diameter of the drill pipe 38 and the inside diameter of the casing hanger 134 is sufficient to result in a downward axial load on the tool in excess of the strength of the shear pins 226, these pins will break and the tool will drop with respect to the slip ring 224 until the sloping surface 232 of the lower gear housing 44 comes to rest on the upper sloping surface 234 of the casing hanger 134, as is diagrammatically illustrated in FIG. 10B. This transfers all the axial load from the packoff 118 to the casing hanger 134, so that the packoff now can be pressure tested under conditions that are more equivalent to those to be encountered in actual service.

As test pressure is applied through the choke and/or kill line 230, if the seal 130 or the check valves 200 leak the pressure is free to travel back up the center of the tool through the bores 208, 206 and 204, and through the check valve 182 and drill string 38, to the surface where these leaks can be detected. If the packoff seal elements 152,154 leak, the hydraulic pressure in the drill string 38 is increased until it causes sufficient additional rotation of the packoff's upper body element 116 and corresponding additional compression of the seal elements to eliminate the leak.

When testing is completed, the check valve 182 is removed by wireline (not shown), and the tool 30 retrieved by lifting straight up on the drill string 38. With the check valve 182 removed, fluid in the drill string 38 is free to flow out the bottom of the tool 30, or outwardly through the passage 202 and thence upwardly through the passages 198 and check valves 200 into the well bore 194. As soon as the lugs 172 have disengaged the packoff, the coil spring 188 will return the piston 60 to its original position shown in FIG. 1A.

DESCRIPTION OF THE PREFERRED EMBODIMENTS

Figure 11A:
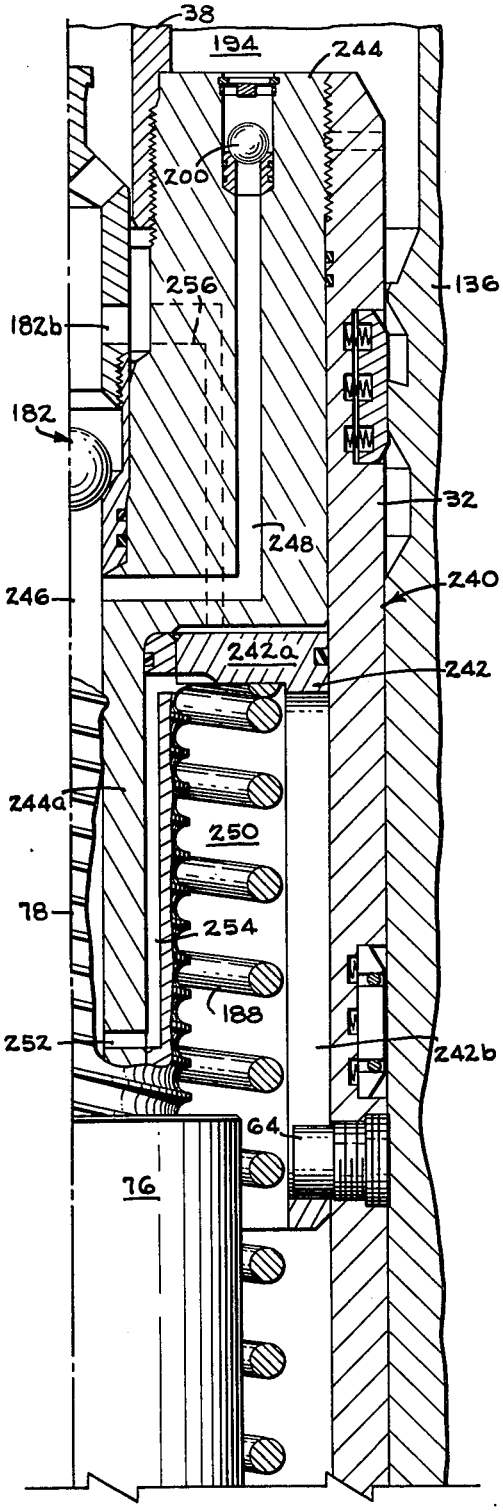
FIGS. 11A and 11B together comprise an elevation, partially in section, of one embodiment of packoff running and setting tool according to the present invention.
Figure 11B:
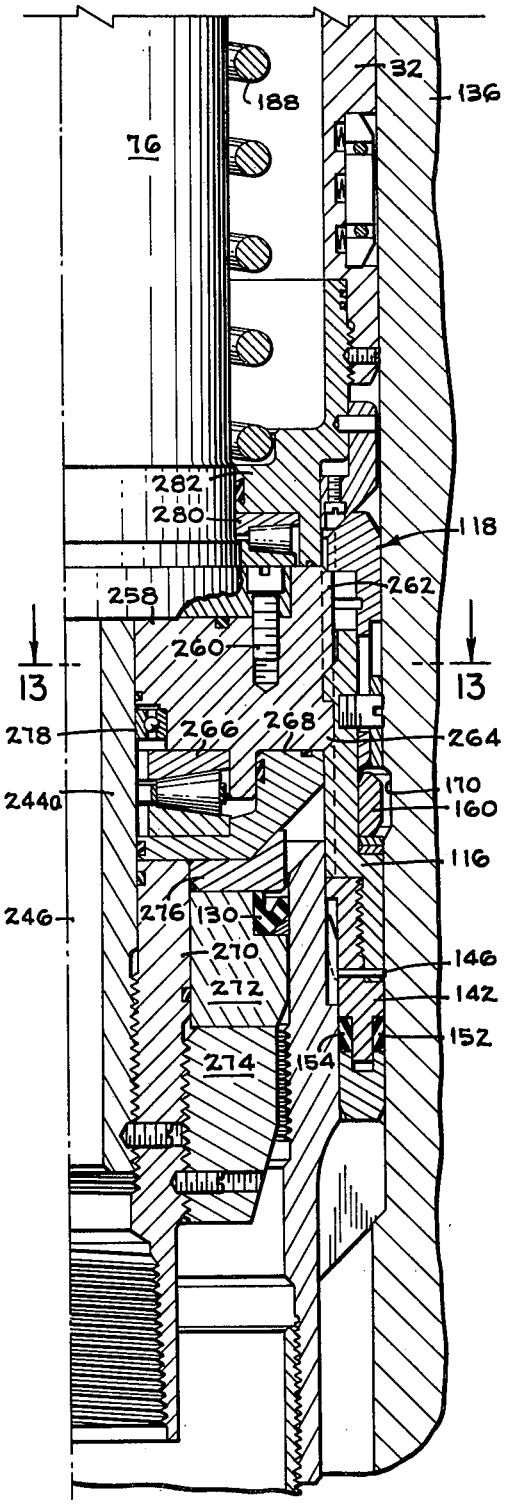
Figure 13:
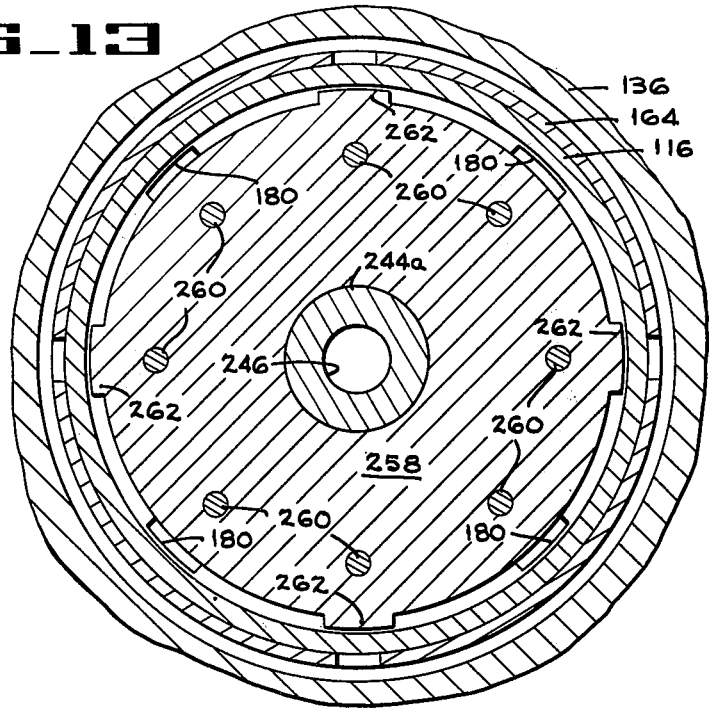
FIG. 13 is a transverse section taken along the line 13—13 of FIG. 11B.

Embodiment of FIGS. 11A, 11B and 13

This embodiment of the present invention is identical in many aspects with the Garrett invention illustrated in FIGS. 1–10, but differs primarily in that the hydraulic piston is connected to the ball screw instead of the ball nut, and the torque is transmitted from the rotatable ball nut to the packoff through a single drive element instead of a gear system. Where the elements of both inventions are identical, they have been disignated by the same reference numbers for the sake of simplicity.

As seen in FIG. 11A the annular piston 242 of the running and setting tool 240 has an upper head portion 242*a* that extends radially inwardly from the skirt portion 242*b*, and the upper end of the ball screw 78 is welded or otherwise fixed to this head portion so that the screw does not rotate as the piston moves axially within the tool's body 32. The upper end element 244 of this tool is provided with four ball check valves 200 (only one shown) like its counterpart in the FIGS. 1–10 apparatus, but the valves 200 of this FIG. 11 embodiment control the exit of fluid only from the bore 246 of the element 244, this fluid being conducted from this bore to the valves 200 by a plurality of passages 248

(only one shown). The space 250 below the piston 242 is vented to the bore 246 by a passage 252 and a counterbore 254 in the upper portion of the ball screw 78, so that the fluid below the piston can escape to the well bore 194 above the tool 240 as the piston moves downward.

Hydraulic pressure in the drill string 38 is conducted through the lateral ports **182*b* (only one shown) in the ball check valve 182 and then through one or more passages 256 (only one shown) onto the top of the piston 242, causing the piston and the ball screw 78 to move downwardly in unison and thereby imparting rotation to the ball nut 76. The lower end of the ball nut (FIG. 11B) is rigidly connected to an annular drive element 258 by a plurality of cap screws 260. This drive element 258 has circumferentially spaced lugs 262,264, that connect it to the pack-off 118 in a manner identical to that of the annulus gear 110 of the FIGS. 1–10 apparatus. The drive element 258 and the ball nut 76 are supported on the lower shaft portion 244*a* of the tool's upper end element 244 through a thrust bearing assembly 266, a support ring 268, a tubular end element 270, appropriately sized spacing elements 272,274, and a retainer ring 276 for the interference-fit seal element 130. Radial support between the drive element 258 and the shaft 244*a* is afforded by a bearing assembly 278, and an upper thrust bearing assembly 280 provides rotatable support between the drive element 258 and an annular extension 282 of the tool body 32, this extension also functioning as a support for the helical piston return spring 188**.

Figure 12A:
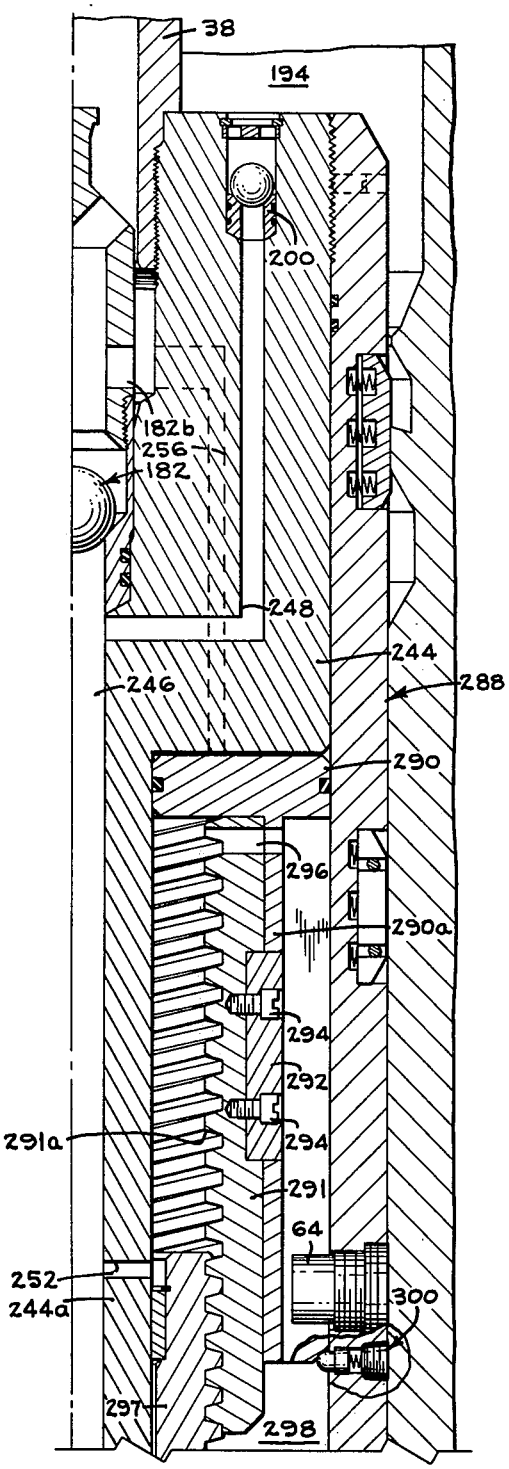
FIGS. 12A and 12B together comprise an elevation, partially in section, of another embodiment of the packoff running and setting tool according to the present invention.
Figure 12B:
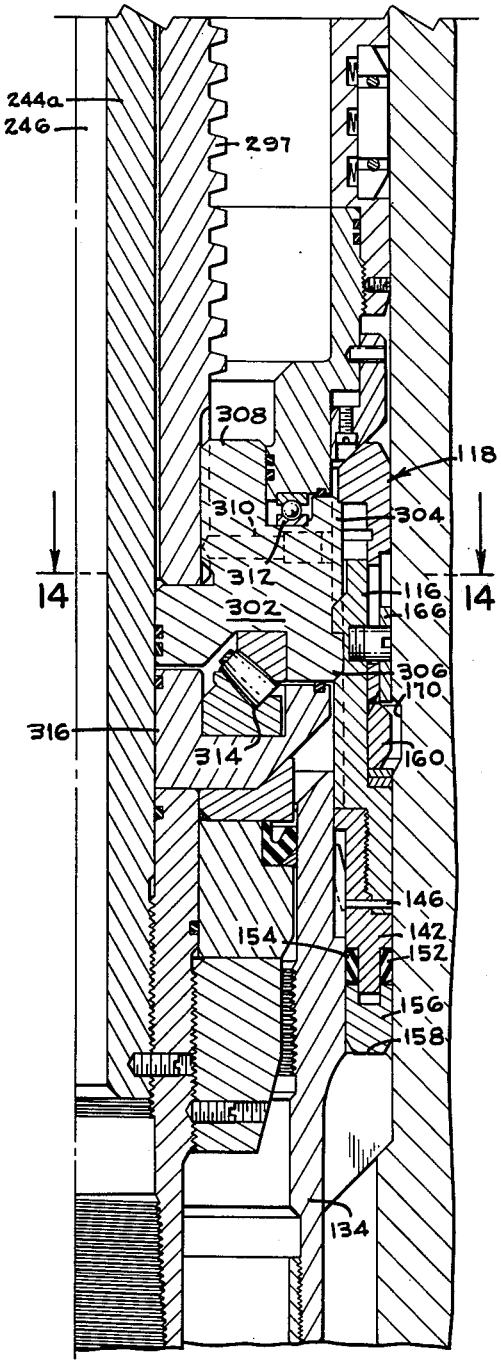
Figure 14:
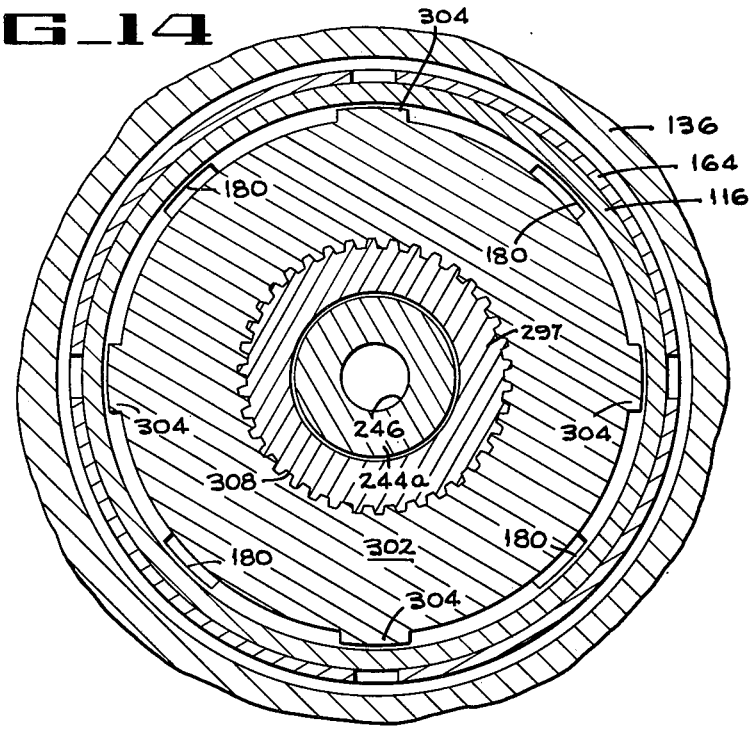
FIG. 14 is a transverse section taken along the line 14—14 of FIG. 12B.

Embodiment of FIGS. 12A, 12B and 14

This embodiment of the present invention resembles in certain respects both of the previously described tools, and where the elements are the same they are referenced by the same numbers.

The annular piston 290 of the tool 288 of this embodiment surrounds an acme nut 291 having internal acme threads **291*a* with a pitch appropriate for satisfactory operation, and is releasably secured thereto in nonrotatable manner by one or more longitudinal keys 292 and a plurality of cap screws 294. A radial passage 296 through the upper end of the piston's skirt portion 290*a* and the acme screw 297 allows fluid in the space 298 below the piston to escape into the interior of the piston as it moves downward in response to hydraulic pressure. From this location the fluid then can migrate to the well bore through the radial passage 252, the bore 246, and the passage 248 of the upper end element 244, and of course check valves 200** (only one shown).

In this embodiment the piston 290 is returned to its original position by applying fluid pressure through the passage 252 to the underside of the piston, and also venting the pressure and fluid from the top of the piston through the passage 256. This can be done at the surface after the tool is retrieved for further use, or in the well after the tool has been disengaged from the pack-off, by removing the check valve 182 and installing an appropriate flow reversal tool. Since no piston return spring is needed, it has been eliminated, but a detent assembly 300 is included in the wall of the tool body 32 to retain the piston 290 in its uppermost position until hydraulic fluid is admitted through the drill string 38.

The lower end of the rotatable acme screw 297 is connected to the packoff 118 by an annular drive element 302, this element having exterior circumferentially spaced lugs 304,306 (FIG. 12B) that function in the same manner as lugs 262,264 (FIGS. 11B). The drive element 302 is non-rotatably connected to the acme nut 291 by a spline system 308 and an anti-rotation screw 310, and this element is rotatably supported in the tool by an upper thrust bearing assembly 312, and also by a lower thrust bearing assembly 314 that is supported in an annular bearing housing 316.

EMBODIMENTS OF FIGS. 15, 16 AND 17

This embodiment of the present invention is almost identical in structure and function with that of FIGS. 12A, 12B and 14, the differences residing in the manner by which the axial force produced by the thrust load on the acme screw is supported.

Figure 15:
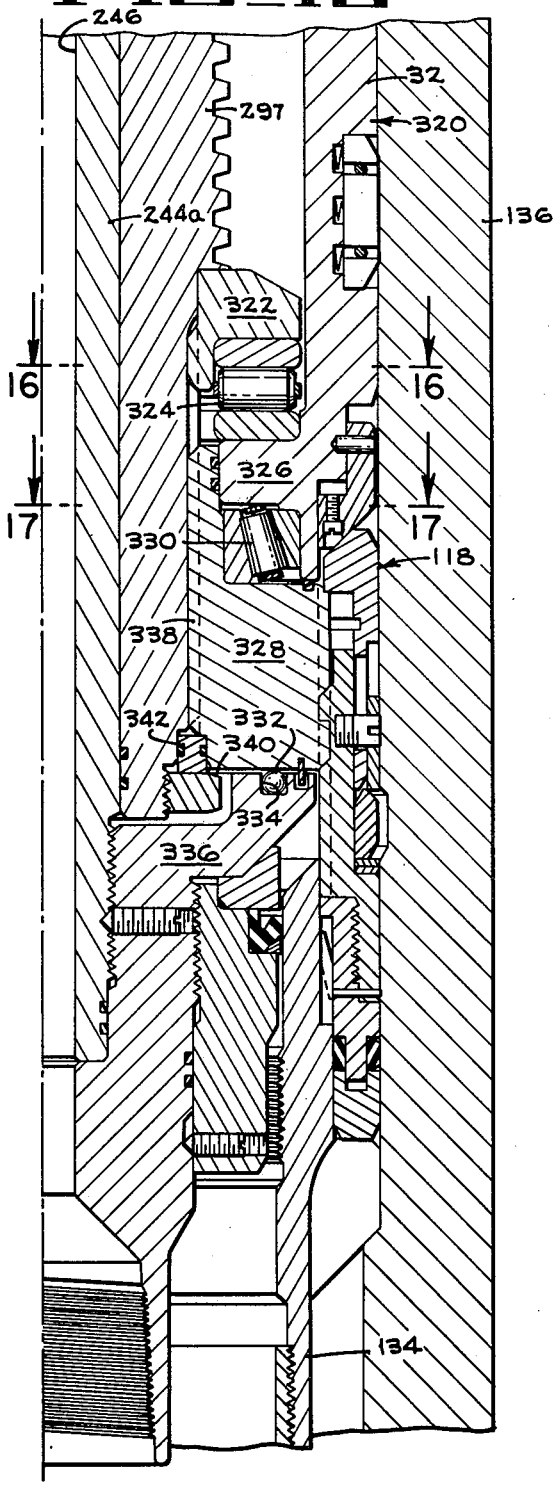
FIG. 15 is a fragmentary elevation in section of a third embodiment of packoff running and setting tool according to the present invention.
Figure 16:
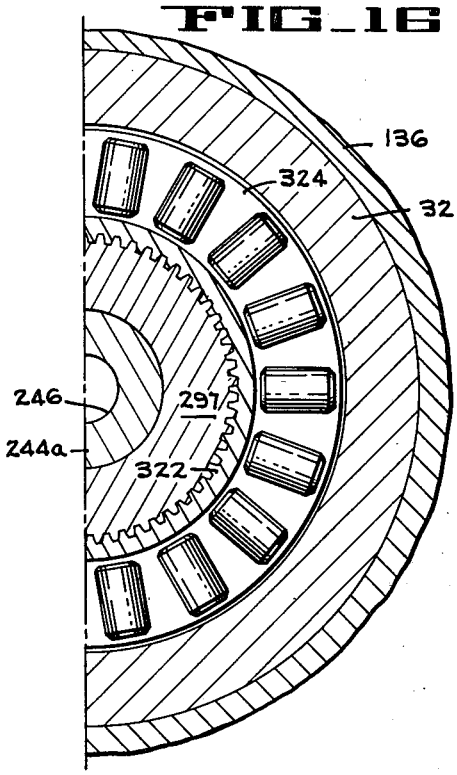
FIG. 16 is a transverse section taken along the line 16—16 of FIG. 15.

As shown in FIG. 15, the thrust load of the rotatable acme screw 297 of the tool 320 is imposed on the tool body 32, instead of on the upper end element's lower shaft portion **244*a*, through an annular upper bearing housing 322, a thrust bearing 324, and a lower bearing housing 326 that is formed as a radial inward flange of the tool body 32. This arrangement results in a stronger support for this axial force than that provided by the shaft 244*a*, as in the embodiment of FIGS. 12A and 12B**.

Figure 17:
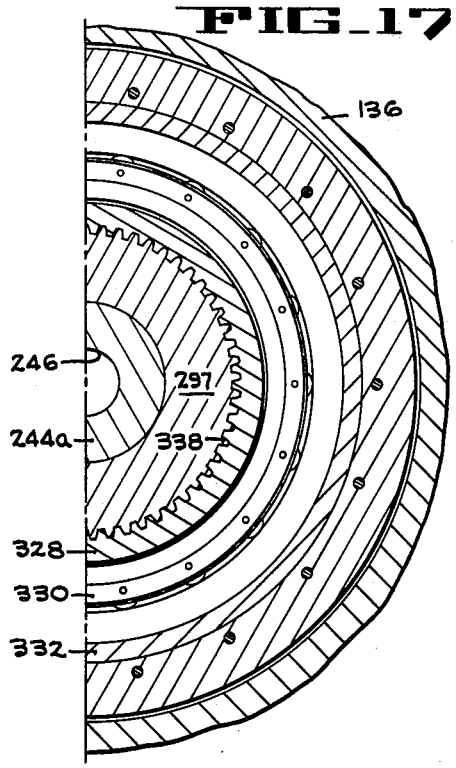
FIG. 17 is a transverse section taken along the line 17—17 of FIG. 15.

Radial support for the acme screw 297 and the annular drive element 328 is provided by a bearing assembly 330, and a plurality of spherical spacer balls 332 (only one shown) disposed in an annular groove 324 in the upper surface of an inner support member 336 serve to assure that the drive element 328 will remain rotatable even if subjected to extreme axial loads. As is apparent from the FIGS. 15 and 17, the drive element 328 is secured to the acme screw 297 by splines 338, and a nut 30 and a seal assembly 342 hold the drive element on the screw 297.

Figure 18:
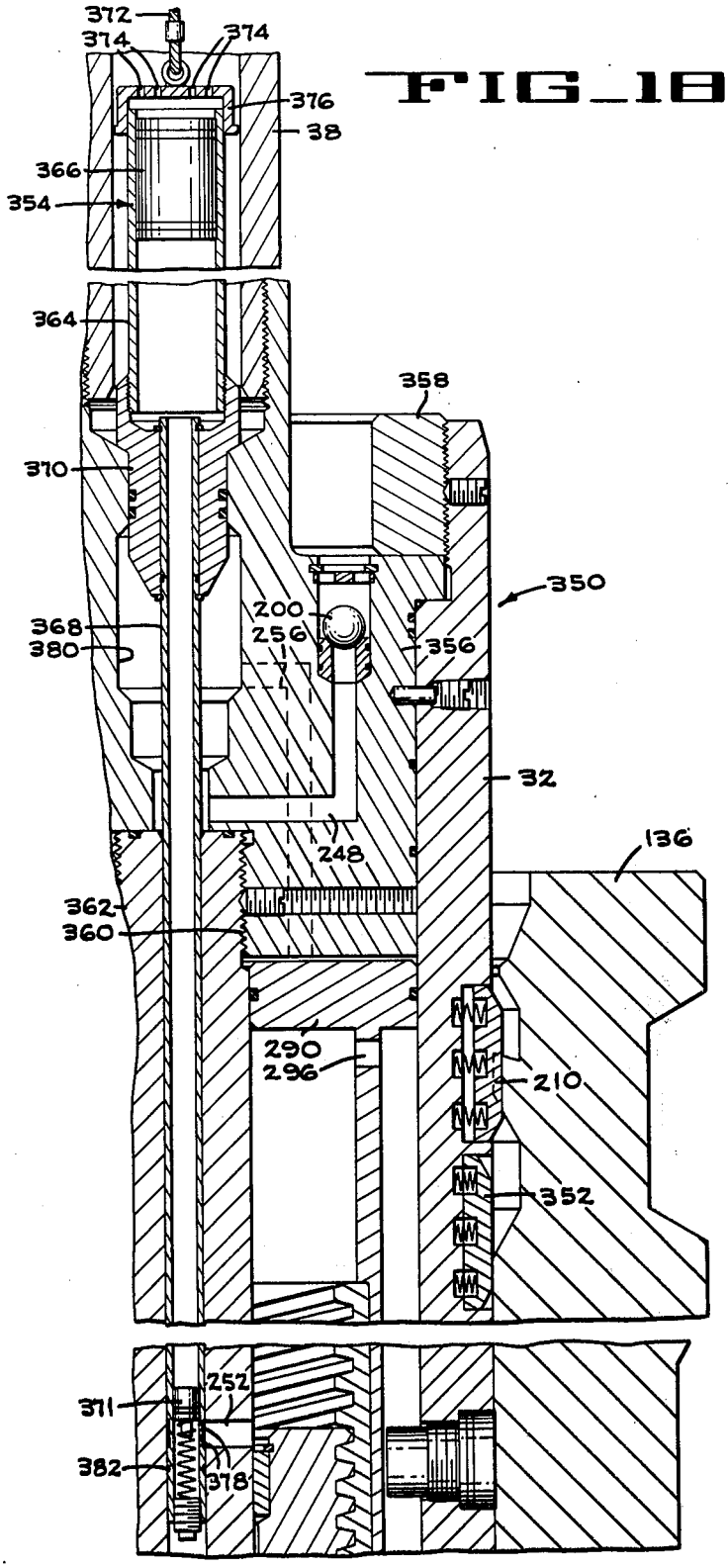
FIG. 18 is a fragmentary elevation in section of a fourth embodiment of packoff running and setting tool according to the present invention, and of a tool for use in returning the piston of the running and setting tool into its original position without withdrawing the running and setting tool from the packoff.

Embodiment of FIG. 18

The packoff running and setting tool 350 illustrated in FIG. 18 is practically identical to that of FIGS. 12A and 12B, the main differences being the provision of a secondary set of reaction dogs 352 mounted on the tool body 32 just below the dogs 210, and a piston resetting tool 354 for returning the piston 290 to its original position as shown. The upper end element 356 has a somewhat different configuration than its counterpart 244 of FIG. 12A, primarily for manufacturing and assembling convenience, and is held in the tool body 32 by an annular, externally threaded nut 358. In addition, the end element is threadedly connected at 360 to a separate tubular shaft 362, instead of having an integral shaft portion as **244*a* of FIG. 12A**.

The resetting tool 354 has an upper tubular portion 364 that functions as a cylinder for a hydraulic piston 336, and a lower, relatively small diameter conduit portion 368 that extends downward from the lower end element 370 of the cylinder 364 and that has a spring-biased back pressure valve 371 in its lower end.

If it is desired to reset the packoff tool 350 while it is in the well, i.e., return the piston 290 to its original "up" position shown in FIG. 18, the retrievable ball check valve 182 (not shown) is removed from the upper end element 356 by wireline, and the resetting tool 354, previously filled with clean oil, is lowered by a wireline 372 through the drill string 38 into the illustrated position in the tool 350. The tool 350 then is lifted until it disengages the packoff 118, and hydraulic pressure is then applied to the drill string 38. This pressure enters the cylinder 364 through ports 374 in its top cap 376 and forces the piston 366 in a downward direction. As the piston 366 moves downwardly, the backpressure valve 371 moves down past the lateral port 378 in response to the pressure created in the fluid in the tool 354 by movement of the piston 366, thereby allowing the fluid in the tool 354 to flow through passage 252 and into the interior of the piston 290, and through port 296 into the space below the piston 290, causing the piston 290 to return to its original upper position. As the piston 290 rises, the hydraulic fluid above it exits to the well bore above the tool 350 through passage 256, the bore 380 of the end element 356, the passage 248, and the check valve 200. An external annular seal 382 is provided around the lower end of the conduit portion 368 to prevent downward escape of hydraulic fluid from between this conduit portion 368 and the tubular shaft 362.

The resetting tool 354 then is removed, the retrievable check valve 182 is reinstalled, and the tool 350 is then lowered as far as it will go. When hyraulic pressure is reapplied to the drill string 38, the tool will rotate until either the secondary reaction dogs 352 or the primary dogs 210 engage the axial slots provided for them in the wellhead 136, thereby preventing further rotation of the tool. If it has not already done so, the tool will then drop to engage the packoff 118 and come to rest on the shoulder 158 of the casing head 134. As this final drop of the tool occurs, the primary reaction dogs 210 will engage their slots in the wellhead at which time the tool is in position for continuation of the packoff setting procedure. It should be noted that the foregoing piston resetting procedure can be repeated as often as required to fully set the packoff.

EMBODIMENT OF FIG. 19

If the difference between the outside diameter of the drill pipe 38 and the outside diameter of the packoff running and setting tool of this invention is of such magnitude that the axial load imposed on the tool by the pressure to which it is subjected during testing of the packoff exceeds the strength of the tool's bearing assemblies, these assemblies can be spring-mounted in the tool so that the springs will deflect under test pressure and allow the axial load to be imposed on the casing hanger without harm to the bearings. When the test pressure is relieved, the springs will return to their normal position and the bearings will be undamaged.

Figure 19:
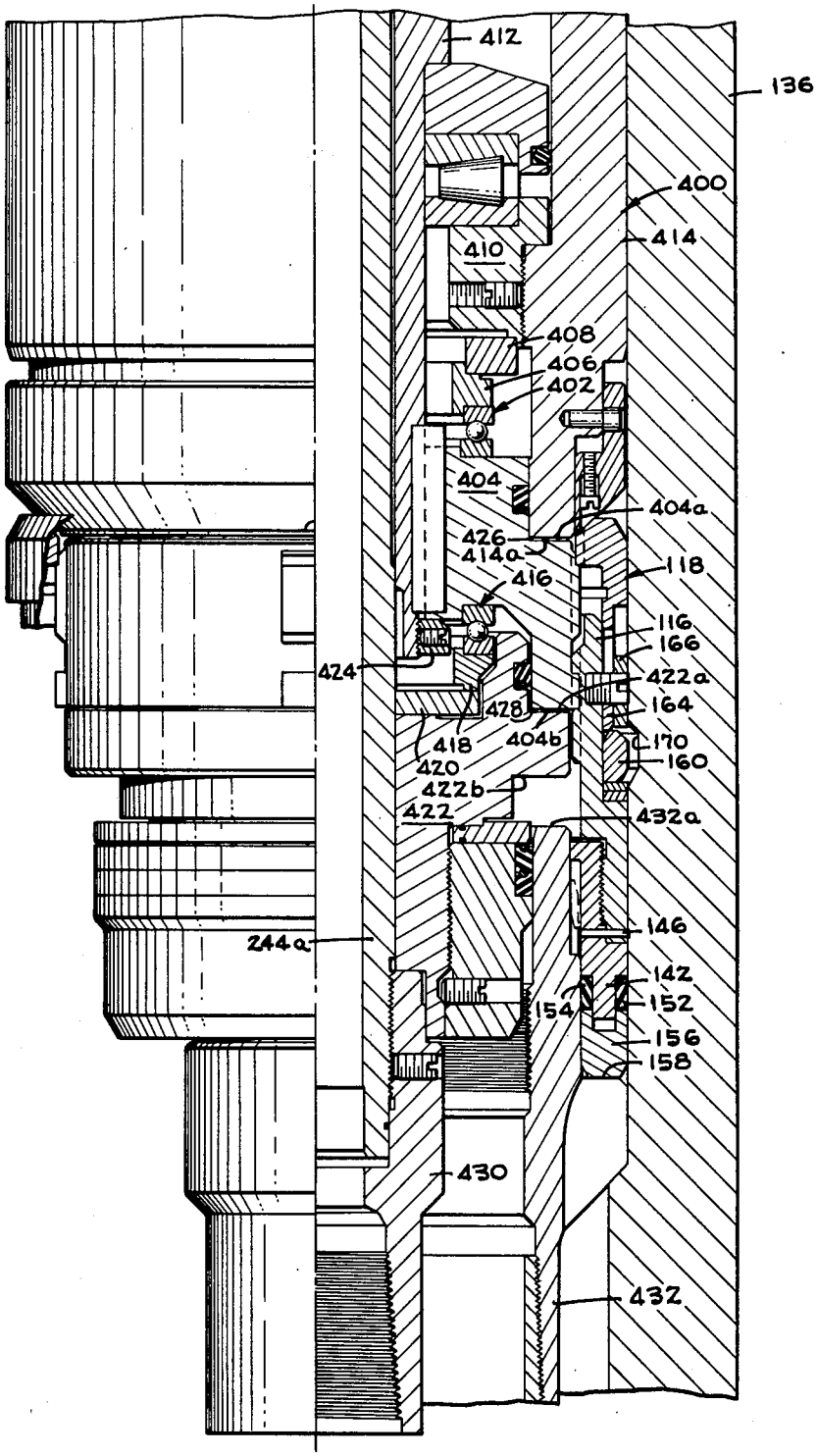
FIG. 19 is a fragmentary elevation in section of a fifth embodiment of packoff running and setting tool according to the present invention.

A running and setting tool 400 embodying this feature of the present invention is illustrated in FIG. 19 wherein the upper thrust bearing assembly 402 of the tool's rotatable drive element 404 is mounted between the drive element and an annular upper bearing housing 406, and an upper annular spring washer 408 extends between the bearing housing 406 and the annular lower bearing housing 410 of the ball screw 412, the housing 410 being rigidly secured to the tool's body 414. The lower thrust bearing assembly 416 of the tool's drive element 404 is supported by a lower annular bearing housing 418 that rests on a lower annular spring washer 420, which washer is supported by a bushing 422. Each of the spring washers 408,420 has a spring rate that is sufficiently less than the strength of the bearing which it supports, so that under axial force these spring washers will deflect before the bearings are damaged.

By proper adjustment of an annular nut 424 that is threaded onto the lower end of the ball screw 412, the clearance 426 between the drive element's upper surface **404*a* and the opposed lower end 414*a* of the total body 414 can be regulated very closely. Likewise the clearance 428 between the lower end surface 404*b* of the drive element and the opposed upper surface 422*a* of the bushing 422 can be finely adjusted to the required degree by means of the tool's lower end element 430 that is threaded onto the bottom end of the shaft 244*a*** of the tool's upper end element (not shown).

Figure 10B:
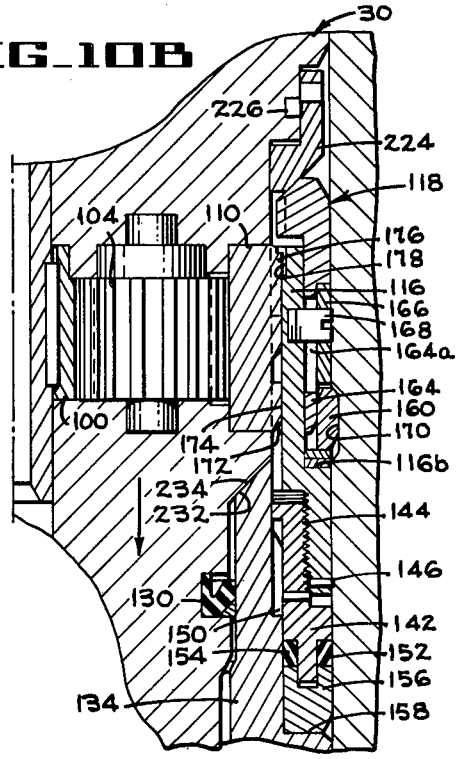

As should be readily apparent, when the packoff 118 is ready for pressure testing in the wellhead 136, the annular radial surface **422*b* of the bushing 422 will have dropped down onto the upper radial surface 432*a* of the casing hanger 432, i.e., in a relationship similar to that of the tool 30 and casing hanger 134 of the embodiment of FIGS. 1–10, as shown specifically in FIG. 10B. Accordingly, when test pressure is applied, the spring washers 408,420 will deflect downwardly until the annular clearances 426,428 are eliminated, and the axial force on the tool is transmitted from the tool body 414 directly through the rotating drive element 404 and the bushing 422 to the casing hanger 432 without overloading either bearing assembly 402 or 416**.

It should be understood that, if desired, this spring washer system for protecting the bearings can be employed in each of the embodiments of the present invention, and thus this feature of the invention is not limited to the embodiment of FIG. 19. Furthermore, it should be clear that the acme nut and screw of the embodiments of FIGS. 12A, 12B, and 14–18 are interchangeable with the ball nut and screw shown in the other embodiments.

Although a ball screw assembly, and an acme nut and screw assembly, are described above for converting the tool piston's lineal force into torque, it should be understood that other means, such as a helical spline system, can also be employed for this purpose.

Although the best mode contemplated for carrying out the present invention has been herein shown and described, it will be apparent that modification and variation may be made without departing from what is regarded to be the subject matter of the invention.

I claim:

1. A well tool for running and setting a pressure-holding well device within an outer well element, comprising a. an annular body, b. means for connecting the body to a well pipe for running the well tool into a well, c. fluid piston means disposed within the body for linear movement therein in response to fluid pressure entering said body from the well pipe, d. screw means in said body and connected to said fluid piston means for linear movement with said piston means, e. helical nut means supported in said body for rotation in response to linear movement of the screw means, and f. means connected to the helical nut means to transmit rotary movement of said helical nut means to a pressure-holding well device when said well tool and said well device are interconnected, whereby the pressure-holding well device can be run into a well on the well pipe and then set into fluid pressure-tight condition in the outer well element by hydraulic fluid conducted through the well pipe to the well tool, without rotation of said well pipe.

2. A well tool according to claim 1 wherein the rotary movement transmission means comprises an annular drive element having means for releasable connection to the pressure-holding well device.

3. A well tool according to claim 1 wherein the screw means comprises a ball screw, and the helical nut means comprises a ball nut.

4. A well tool according to claim 1 including at least one thrust bearing means for rotatably supporting thrust forces exerted by the screw means and the helical nut means.

5. A well tool according to claim 4 wherein the thrust bearing means is yieldably supported in the well tool by spring means.

6. A well tool according to claim 4 wherein the thrust bearing means is yieldably supported on the well tool body by spring washer means.

7. A well tool according to claim 1 including means arranged in the annular body to exert a bias on the fluid piston means in a direction opposite to that of linear movement of said piston means in response to fluid pressure from the well pipe, whereby said bias means can function to return said piston means to its original position when said fluid pressure is removed.

8. A well tool according to claim 1 wherein the pressure-holding well device comprises a compression-set well packoff having two relatively-rotatable elements, and wherein the packoff is set in the outer well element by rotation of one of said elements by introduction of fluid pressure into the well pipe.

9. A well tool assembly for running and setting a pressure-holding well device within an outer well element, comprising, a. an annular body, b. fluid piston means disposed within the body for linear movement therein between a first position and a second position in response to fluid pressure entering said body, c. means within said body and connected to the piston means to convert the linear movement of said piston means into torque, d. means connected to the linear movement conversion means to transmit said torque to a pressure-holding well device when said well tool and said well device are interconnected, and e. piston return means to cause return of the piston from said second position to said first position in response to fluid pressure entering said body, wherein said piston can be moved between said first and second positions by introduction of fluid pressure into said annular body without removing said well tool assembly from said well.

10. A well tool assembly according to claim 9 wherein the piston return means comprises an tubular fluid cylinder element having fluid inlet means and fluid outlet means, a fluid piston element disposed within said cylinder element for linear movement therein, and pressure-responsive valve means within said cylinder element for opening said fluid outlet means in response to fluid pressure caused by linear movement of said piston element.

11. A well tool assembly according to claim 10, including fluid conduit means in the annular body for cooperation with the piston return means to conduct fluid pressure from said piston return means to the fluid piston means and force said fluid piston means to said first position.

* * * * *

UNITED STATES PATENT OFFICE

CERTIFICATE OF CORRECTION

Patent No. 4,019,579 Dated April 26, 1977

Inventor(s) Erik THUSE

It is certified that error appears in the above-identified patent and that said Letters Patent are hereby corrected as shown below:

Col. 1, line 10, before "The" insert --This application discloses subject matter claimed in the copending application of Michael R. Garrett, Serial No. 650,101, filed on January 19, 1976 and entitled "Apparatus And Method For Running, Setting And Testing A Compression-Type Well Packoff".--.
Col. 1, after line 12, insert --Background of the Invention--.
Col. 1, before line 13, insert --Field of the Invention--.
Col. 1, line 27, change "sufficienT" to --sufficient--.
Col. 1, line 36, change "ofpackoff" to --of packoff--.
Col. 1, lines 42 & 43, delete "different difficult release" and insert therefor --difficult to release--.

Col. 4, line 22, delete "means new and improved" and insert therefor --new and improved means--.

Col. 5, line 60, after "7A," delete the hyphen.

Col. 10, line 54, change "disignated" to --designated--.
Col. 11, line 23, after "tubular" insert --lower--.
Col. 12, line 35, change "30" to --340--.
Col. 12, line 55, change "336" to --366--.

Signed and Sealed this

Sixteenth Day of October 1979

[SEAL]

Attest:

RUTH C. MASON
Attesting Officer

LUTRELLE F. PARKER
Acting Commissioner of Patents and Trademarks